US007824203B2

(12) United States Patent
Littlewood

(10) Patent No.: US 7,824,203 B2
(45) Date of Patent: Nov. 2, 2010

(54) COUPLER WITH A SLIDABLE ACTUATOR FOR ELECTRICAL, FLUID AND/OR OPTICAL TRANSMISSION

(75) Inventor: Thomas David Shon Littlewood, Dyce (GB)

(73) Assignee: Hydrasun AMC Limited, Aberdeen (GB)

( * ) Notice: Subject to any disclaimer, the term of this patent is extended or adjusted under 35 U.S.C. 154(b) by 654 days.

(21) Appl. No.: 11/792,333

(22) PCT Filed: Dec. 19, 2005

(86) PCT No.: PCT/GB2005/004950

§ 371 (c)(1),
(2), (4) Date: Jun. 4, 2007

(87) PCT Pub. No.: WO2006/067422

PCT Pub. Date: Jun. 29, 2006

(65) Prior Publication Data

US 2008/0141497 A1 Jun. 19, 2008

(30) Foreign Application Priority Data

Dec. 21, 2004 (GB) ..... 0427932.9

(51) Int. Cl.
*H01R 13/15* (2006.01)

(52) U.S. Cl. ..... 439/265

(58) Field of Classification Search ..... 439/265; 285/24–26, 124.1

See application file for complete search history.

(56) References Cited

U.S. PATENT DOCUMENTS

| | | | | |
|---|---|---|---|---|
| 4,411,454 | A * | 10/1983 | Nayler et al. | 285/26 |
| 4,438,996 | A * | 3/1984 | Zehren | 439/137 |
| 5,049,091 | A * | 9/1991 | Tanaka | 439/500 |
| 6,530,794 | B2 * | 3/2003 | Littlewood | 439/265 |
| 2001/0036774 | A1 * | 11/2001 | Littlewood | 439/784 |

* cited by examiner

*Primary Examiner*—Neil Abrams
(74) *Attorney, Agent, or Firm*—Drinker Biddle & Reath LLP

(57) ABSTRACT

An apparatus to connect a connector half (13) at an end of a first cable (15) to a second cable (6) is described as having a male member (32) coupled to the first cable (15) and a female member (31) coupled to the second cable (6). An actuation mechanism includes a tapered surface (33U; 33L) where at least a part (16) of one of the first and second cables is connected to the tapered surface (33U; 33L) by a trapping means (33L; 16L). Preferably, the apparatus is arranged such that movement of the tapered surface (14; 33U; 33L) along a longitudinal axis in a first direction forces the said part (16) to move radially outwardly to form the connection and movement of the tapered surface (33U; 33L) in the opposite direction along the longitudinal axis forces the said part (16) to move radially inwardly to break the connection. Preferably, the trapping means (33L; 16L) is a key (16L) provided on the said part (16) and a slot (33L) formed in the mandrel (14) in which the key (16L) is trapped. A guide means (36) is also provided to constrain the said part (16) to move only in the radial direction.

29 Claims, 14 Drawing Sheets

SECTION A–A

SECTION A–A

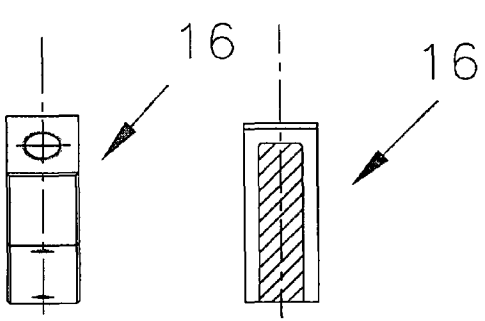
VIEW B–B
Fig. 9d
SECTION C–C
Fig. 9e
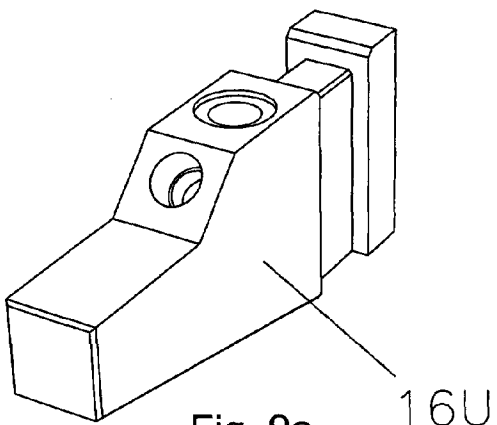
Fig. 9a
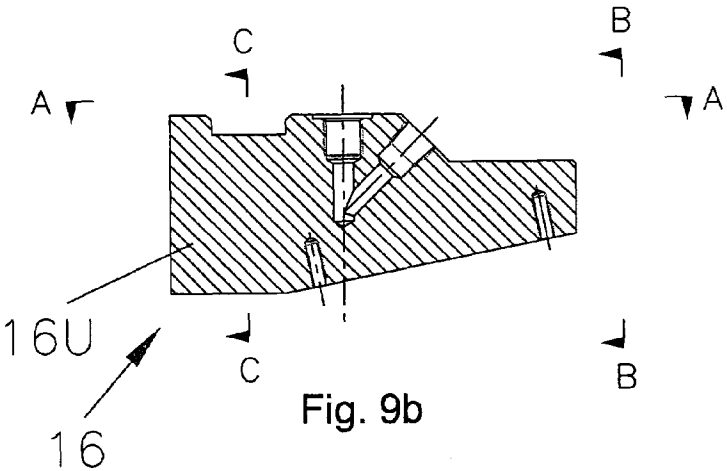
Fig. 9b
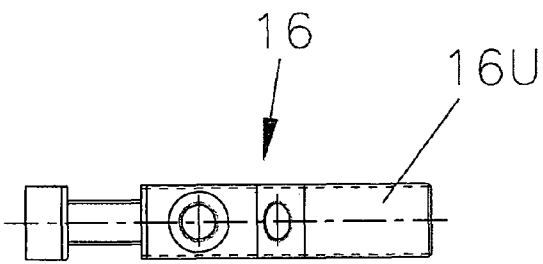
VIEW A–A
Fig. 9c

SECTION A–A

SECTION B–B

SECTION C–C

DETAIL PART SECTION A–A

VIEW B–B

SECTION C–C

VIEW A–A

COUPLER WITH A SLIDABLE ACTUATOR FOR ELECTRICAL, FLUID AND/OR OPTICAL TRANSMISSION

FIELD OF THE INVENTION

This invention relates to a coupler for joining connections and particularly to a multiway coupler for joining a number of connections, particularly but not exclusively, for use in hostile environments, for example, subsea environments.

BACKGROUND OF THE INVENTION

Umbilicals used underwater typically comprise a number of internal cables, hoses or wires carrying, for example electrical wires, hydraulic lines, pneumatic lines, fibre optic cables or other types of wires, lines, cables or the like (hereinafter referred to as "cables") used for transmitting, for example, power, signals, data, etc. At the point where the umbilical connects to a host facility or structure with corresponding cables, it may be necessary to connect each cable within the umbilical separately. Such connections may be difficult and time consuming to effect.

This problem has been tackled by connecting and locking two parallel plates, each plate comprising mating connector halves mounted on their mating face. However, these plates are difficult to align and connect, and the connectors mounted on them are prone to damage and to dirt ingress. The problems associated with these plates are exacerbated in subsea or other difficult environments.

U.S. Pat. No. 6,530,794 to the present inventor, Thomas David Shon Littlewood, describes a coupler for joining connections and the present invention generally, but not exclusively, relates to improvements to the coupler described therein and the whole contents of U.S. Pat. No. 6,530,794 are incorporated herein by reference.

BRIEF SUMMARY OF THE INVENTION

According to a first aspect of the present invention there is provided an apparatus to connect a first cable to a second cable, the apparatus comprising:

a male member coupled to the first cable;

a female member coupled to the second cable, and an actuation mechanism comprising a tapered surface wherein at least a part of one of the first and second cables is connected to the tapered surface by a trapping means.

Preferably, the part of one of the first and second cables is connected to the tapered surface such that movement of the tapered surface along a longitudinal axis in a first direction forces the said at least part to move in a first direction substantially transverse to the longitudinal axis and movement of the tapered surface along the longitudinal axis in a second opposite direction forces the said at least part to move in a second opposite direction substantially transverse to the longitudinal axis.

According to the first aspect of the present invention there is provided a method of connecting a first cable to a second cable, the method comprising the steps of:

providing a male member having a longitudinal central axis coupled to the first cable;

providing a female member coupled to the second cable;

providing an actuation mechanism comprising a tapered surface wherein at least part of one of the first and second cables is connected to the tapered surface;

wherein the tapered surface is capable of moving along the longitudinal central axis of the male member in a first direction such that the said part is forced to move in a first direction substantially transverse to the longitudinal central axis in order to connect the first and second cables together; and wherein the tapered surface is capable of moving along the longitudinal central axis in an opposite direction to force the said part to move in an opposite direction substantially transverse to the longitudinal central axis in order to disconnect the first and second cables.

Preferably, the part of one of the first and second cables is connected to the tapered surface by a trapping means.

Typically, the trapping means comprises a key provided on one of the said part and the tapered surface and a slot in which the key is trapped provided on the other of the said part and the tapered surface.

Typically, the male member comprises a mandrel wherein the tapered surface(s) are formed on the mandrel.

The trapping means preferably forces the said part to move in a first radial direction in response to movement of the tapered surface along the first direction of longitudinal movement of the male member in order to connect the first and second cables together and more preferably the trapping means forces the said part to move in the second radial direction in response to movement of the tapered surface along the second direction of longitudinal movement of the male member in order to disconnect the first and second cables. Most preferably, the first radial direction is outwardly from the longitudinal central axis of the male member and the second radial direction is inwardly toward the longitudinal central axis of the male member.

Preferably, the trapping means are arranged to permit sliding movement between the said part of the first cable and the tapered surface in either direction along the longitudinal axis of the male member and to deny relative radial movement between the tapered surface and the said part of the first cable.

Typically it is the part of the first cable that is connected to the tapered surface.

Preferably, the apparatus is adapted to connect a plurality of first cables to a respective plurality of second cables. Typically, each part of the first cable is connected to a respective tapered surface. Accordingly, there are a plurality of tapered surfaces in preferred embodiments, one tapered surface being provided for each said part of the first cable.

Optionally, the degree and/or the height of each tapered surface may be designed or matched with the desired or required length of radial movement required to connect the respective first cable to the respective second cable. Optionally, the height of each of the parts of the first cables may be designed or matched with the desired or required length of radial movement required to connect the respective first cable to the respective second cable, such that a combination of different first cables having different sizes and make up travel lengths are accommodated.

Preferably, the apparatus further comprises a guide means to prevent rotational movement between the male and female members. Typically, the guide means further prevents non-radial movement of the part of the first cable. Typically, the said part of the first cable comprises a sliding surface adapted to permit longitudinal sliding movement with respect to the tapered surface and cause radial movement of the said part. Preferably, the sliding surface and/or the tapered surface is/are planar and/or linearly shaped. Preferably, the said part of the first cable comprises a guiding/aligning slider plate.

According to a second aspect of the present invention there is provided an apparatus to connect a first cable to a second cable, the apparatus comprising:

a male member coupled to the first cable;

a female member coupled to the second cable, and an actuation mechanism operable to move at least a part of the first cable relative to a part of the second cable into connection together, wherein the said portion that moves is constrained in its movement by a guide means.

According to the second aspect of the present invention there is provided a method of connecting a first cable to a second cable, the method comprising the steps of:

providing a male member having a longitudinal central axis coupled to the first cable;

providing a female member coupled to the second cable;

wherein actuation of an actuation mechanism moves at least a part of one of the first and second cables in a first direction substantially transverse to the longitudinal central axis in order to connect the first and second cables together; and constraining the said part to move only along the first direction or in a second direction opposite to the first direction.

Typically, the said part is constrained by a guide means.

Preferably, the guide means is arranged to prevent rotational movement between the male and female members. Typically, the guide means further prevents non-radial movement of the said part that moves and preferably, the guide means prevents longitudinal movement of the said part that moves and more preferably prevents rotational movement of the said part that moves.

Preferably, the guide means comprises a substantially cylindrical member preferably having one or more radially extending slots within which the said part is constrained. Preferably, the said part comprises a flange portion which can act against an outer portion of the guide means surrounding the slot to prevent longitudinal movement of the said part. More preferably, the guide means prevents non-longitudinal movement of the mandrel of the male member, wherein the guide means prevents radial movement of the mandrel. Optionally, one or more cables may pass through apertures formed in the guide means.

Preferably, more than one first cable may be provided with the same sliding surface such that the said more than one first cable move radially synchronously on the same sliding surface.

Preferably, at least part of the second cable which is connected to the first cable is compliant, wherein the said at least part of the second cable is arranged to compensate for different tolerances in the length of travel of the said parts of the first cable.

BRIEF DESCRIPTION OF THE INVENTION

Embodiments of the present invention will now be described, by way of example only, with reference to the accompanying drawings, in which:—

FIG. 9A is a perspective of a block or slider plate of the apparatus of FIGS. 1 and 5A;

FIG. 9B is a cross-sectional view of the slider plate of FIG. 9A;

FIG. 9C is a plan view of the slider plate of FIG. 9A;

FIG. 9D is an end view of the slider plate of FIG. 9B;

FIG. 9E is a view along section C of the slider plate of FIG. 9B;

DETAILED DESCRIPTION OF THE INVENTION

Figure 1:
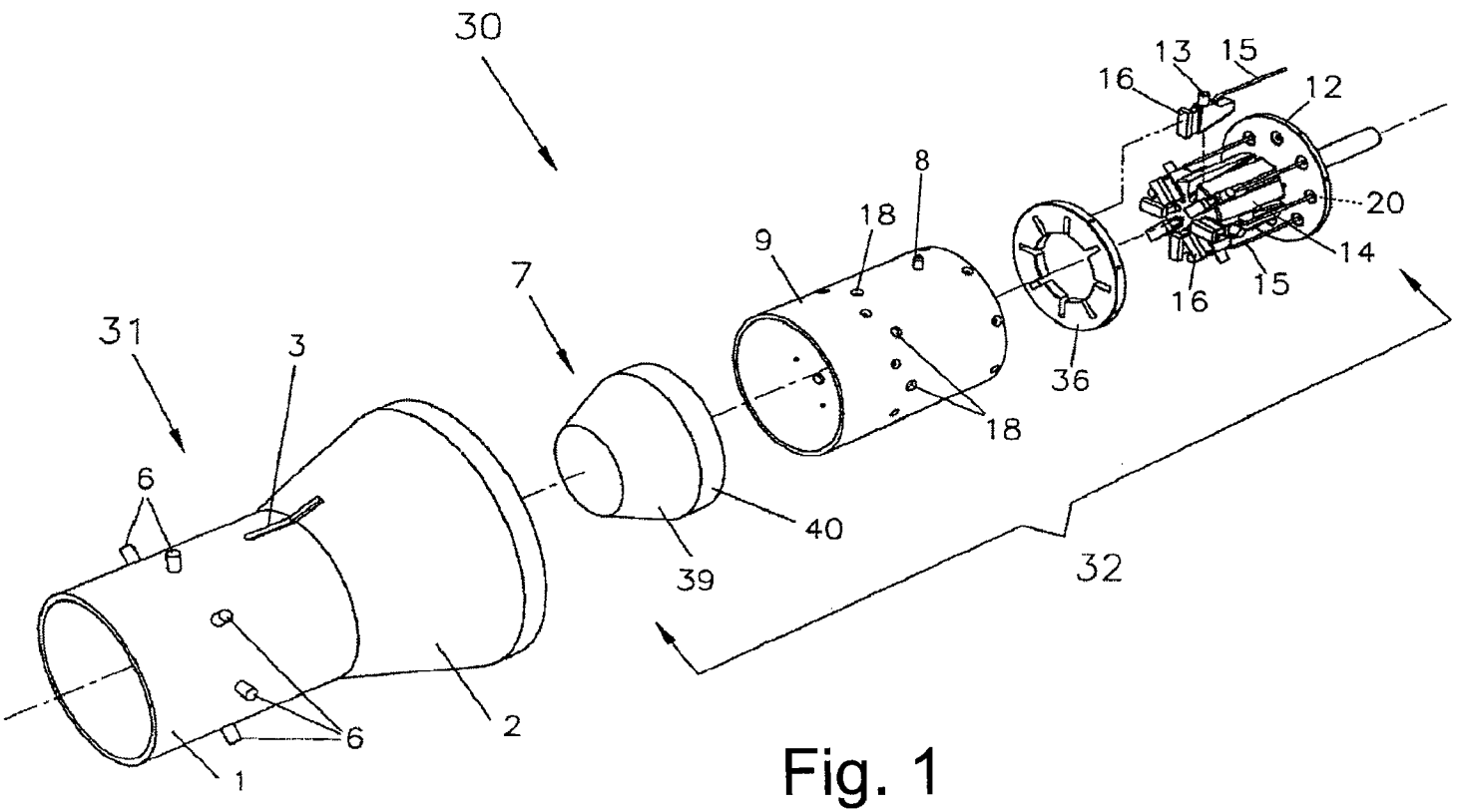
FIG. 1 is an exploded perspective view of an apparatus according to the present invention.
Figure 2:
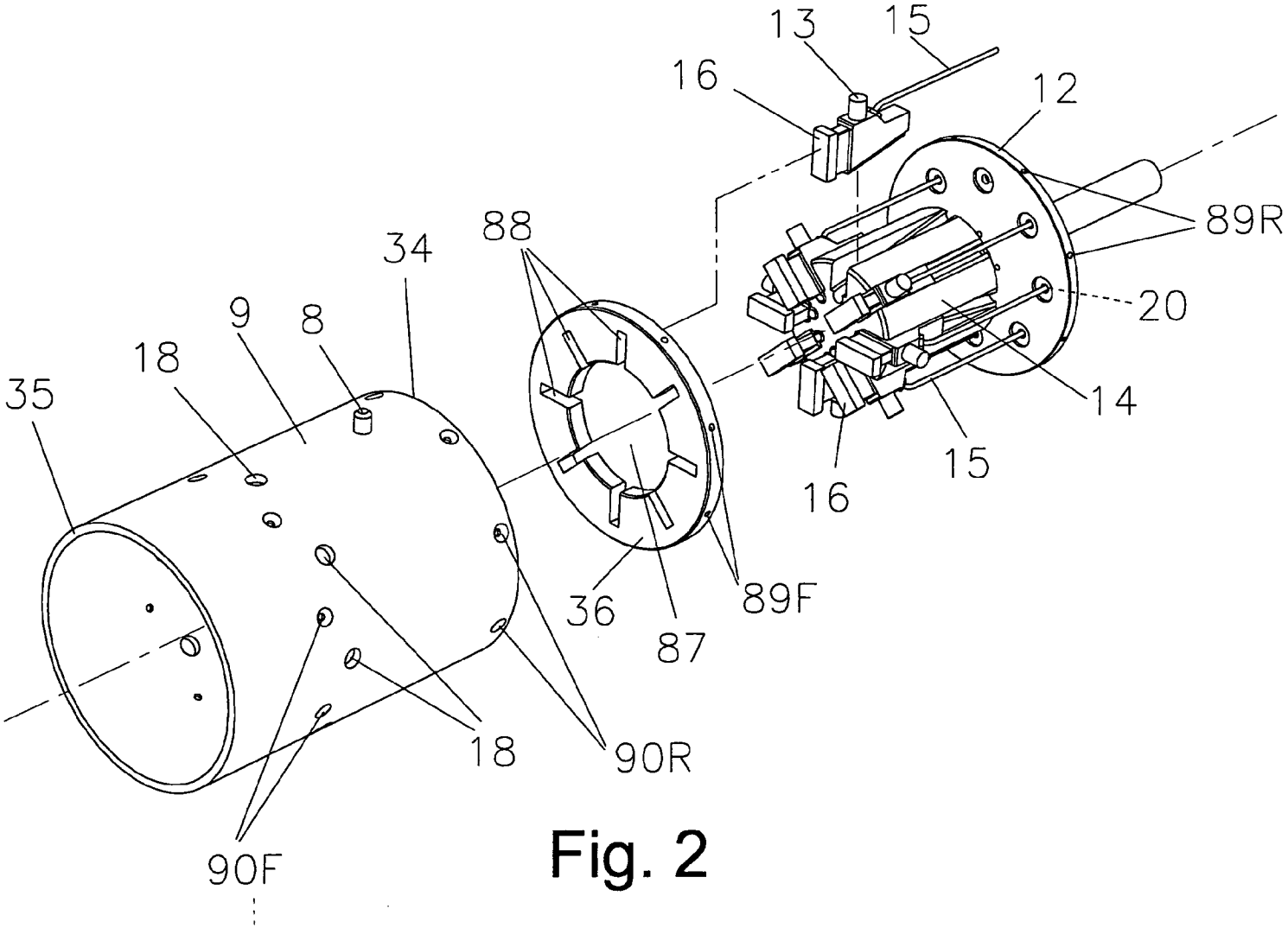
FIG. 2 is a more detailed view of FIG. 1 of some of the components which together form a male member of the apparatus shown in FIG. 1.
Figure 3:
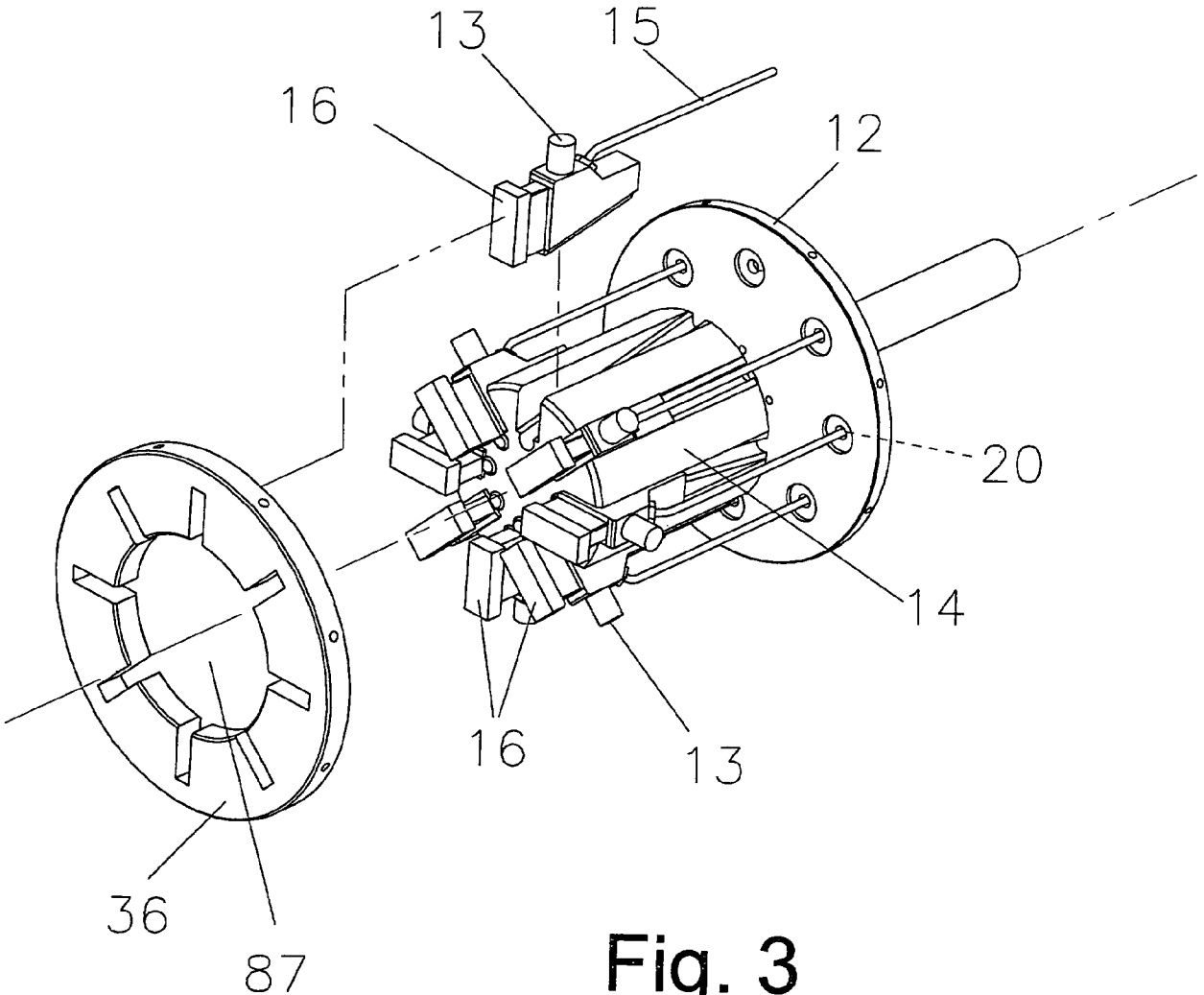
FIG. 3 is a more detailed view of some of the components shown in FIG. 2.

Referring to the drawings there is shown a coupler 30 in accordance with the present invention, comprising a female member or receptacle 31 and a male member 32 which together form a multiway coupler system 31, 32. As will be described, the coupler is suitable for joining a number of connections, cables or fluid conduits such as hoses (hereinafter simply referred to as "cables"), and particularly finds application in hostile environments, such as subsea environments.

The male member 32 comprises a body member or casing 9, a guide plate 36, an end or back plate 12, cables 15, a nose cone 7 and a mandrel 14.

The cables 15 are provided radially around the back plate 12, and extend axially therefrom, and are coupled to blocks or slider plates 16. The cables 15 may be in the form of hollow rods 15 and are typically flexible and may be displaced radially. Each rod 15 is preferably provided with a coil 23 at a location along its length which provides flexibility to the rods 15 in the radial direction and thus permits movement or bending of the rods 15 in their radial direction.

Individual cables/hoses (not shown) of a host facility/umbilical (not shown) are attached to bulkhead connectors 20 on the rear side of the back plate 12. Each cable or hydraulic hose for example (not shown) on the male member 32 extends from bulkhead connectors 20 through the back plate 12, through the cable or rod 15, then through the slider plates 16 and into a connector half 13 which travels through an aperture 18 in the body member 9. The connector half 13 is provided at the end of the cable to engage a complementary connector half 6 provided on a cable portion of the female member 31. The female connector halves 6 are preferably compliant in that they may tolerate small variations in the travel experienced by the male connector halves 13; in other words, they 6, 13 will still all be able to connect with one another if one pair 6, 13 connect before the other respective pairs 6, 13 connect, as will be described subsequently. In other words, by providing compliant mountings for the connector halves 6 on the female coupler member 31, any variations in the travel of the connector halves 13 of the male coupler member 32 (which could be due to manufacturing variations/tolerances) can be accommodated without the actuation mechanism being stopped out by the first pair of connector halves 6, 13 to make up fully, before the pairs of remaining connector halves 6, 13 have made up fully.

The mandrel 14 is coupled at its rear end to a cylinder spacer 45 which in turn is coupled at its rear end to a linear actuation mechanism in the form of a piston (not shown) located within a cylinder 47, where the piston extends co-axially through an aperture 49 formed in the centre of the back plate 12. It should however be noted that the cylinder 47 can be replaced by any suitable linear actuation mechanism which can provide movement in both directions along the longitudinal axis of the mandrel 14.

Figure 4A:
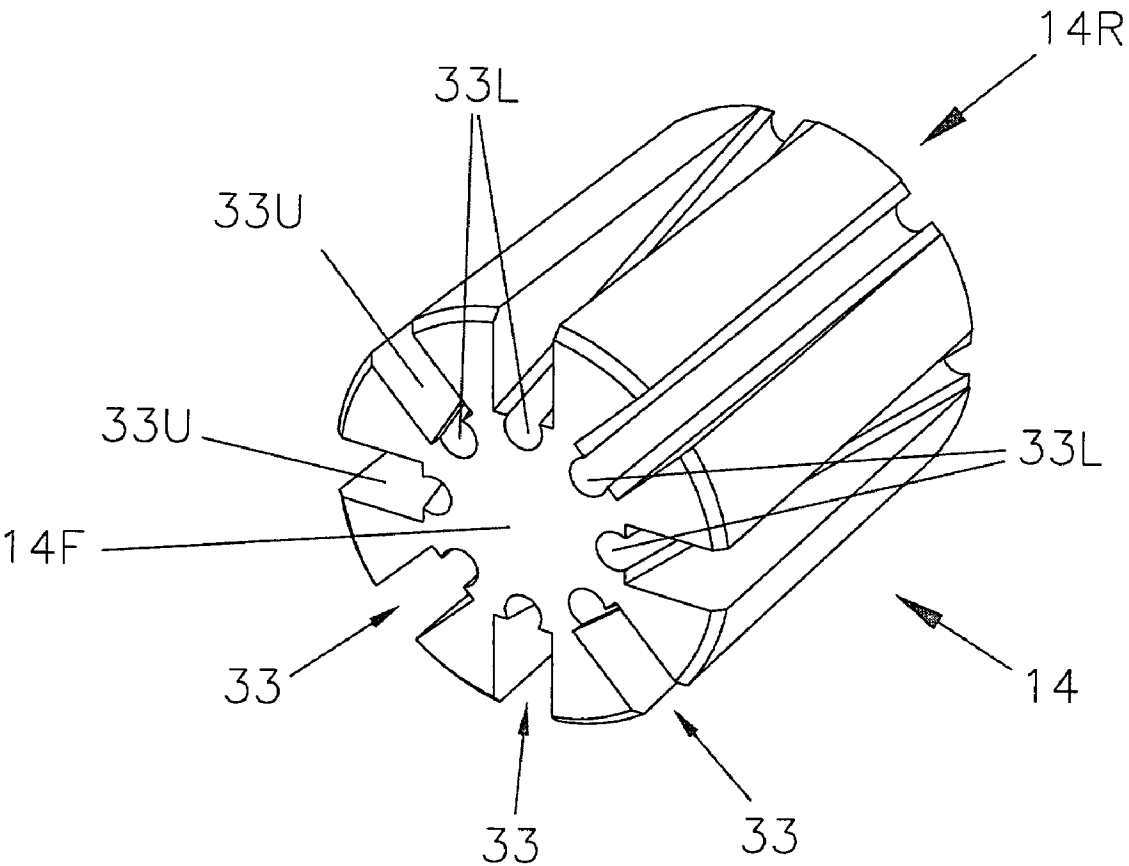
FIG. 4A is a perspective view of a mandrel which forms part of the male member of the apparatus of FIG. 1.
Figure 4D:
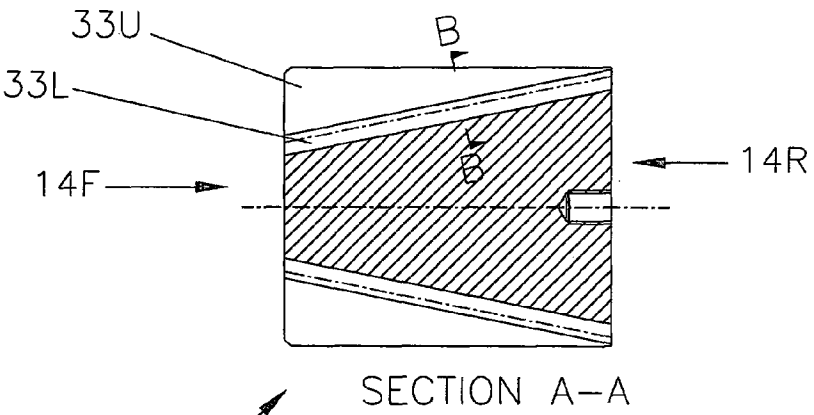
FIG. 4D is a cross-sectional view along section A of the mandrel of FIG. 4C.
Figure 4E:
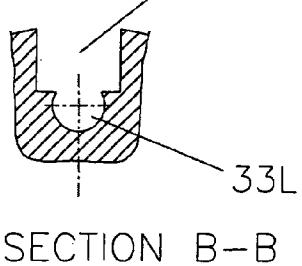
FIG. 4E is a view along section B of the mandrel of FIG. 4D.
Figure 4C:
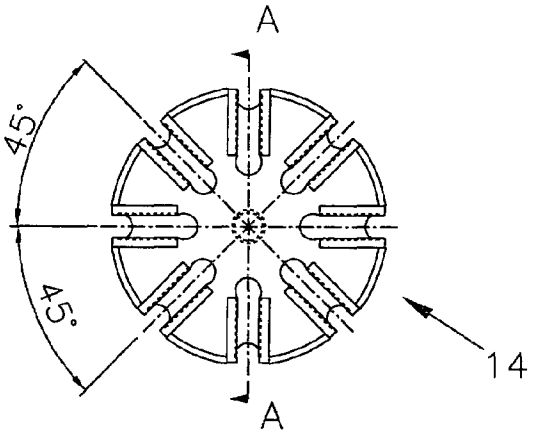
FIG. 4C is an end view of the mandrel of FIG. 4A.
Figure 4B:
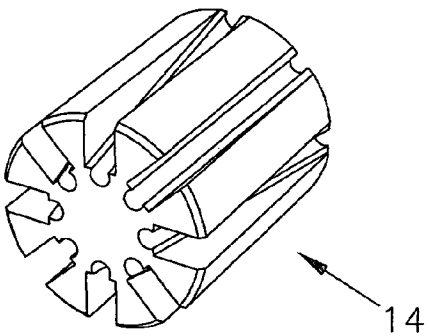
FIG. 4B is another perspective view of the mandrel of FIG. 4A.

The outer circumference of the mandrel 14 is generally cylindrical and a plurality (eight are shown in FIG. 4*a*) of tapered channels 33 are formed therein, where the channels 33 comprise a square box shaped upper portion 33U and a cylindrical groove lower portion 33L. Preferably, the lower portion 33L comprises a groove formed with a radius which circumscribes just over half the circumference of a circle such that the lower portion 33L comprises a part, but over half, circular cross section.

The tapered channels 33 of the mandrel 14 are arranged such that the taper runs substantially linearly from a smaller diameter at the outer most or front end 14F to a greater diameter at an inner most or rear end 14R.

The slider plates 16 comprise a block portion or upper portion 16U and a slider plate retaining bar or lower portion 16L. The slider plate retaining bar 16L comprises a lower most face in the form of a key having a radius which circumscribes just over half the circumference of a circle such that the slider plate retaining bar 16L comprises a part, but over half, circular cross section. The radius of the slider plate retaining bar 16L is arranged to be slightly smaller than the radius of the lower portion 33L of the tapered channel 33 such that the slider plate retaining bar 16L is a sliding fit in both longitudinal directions within the lower portion 33L of the tapered channel 33; however, as will be appreciated, the slider plate retaining bar 16L is also trapped within the lower portion 33L in the radial direction.

The slider plate retaining bar 16L is secured to the upper portion 16U with any suitable fixing means such as screws.

It should however be noted that different connectors 6, 13 with different make up travel lengths may be accommodated on the same mandrel 14 by having tapered channels 33 having different radii and/or different slope of taper and/or by having a different height slider plate 16 in order to suit the particular make up travel of the particular connectors 13; in other words, the tapered channels 33 and/or the slider plates 16 can be varied to suit a combination of different connectors and their particular size and connector "make up" travel lengths.

The guide plate 36 comprises a cylindrical ring with an aperture 87 formed at its centre, the aperture 87 having a diameter which is slightly greater than the outer diameter of the mandrel 14. A number of radially extending slots 88 are formed from the inner bore partly outwards toward the outer circumference of the guide ring 36, the number of slots 88 being provided being equal to the number of slider plates 16. The mandrel 14 is inserted into the aperture 87 of the guide plate 36 and the two are aligned such that the slots 88 are co-axially arranged with the slider plates 16 and cables 15. The outer diameter of the mandrel 14 is arranged to be a close fit within the aperture 87 of the guide plate 36. The mandrel 14 is therefore constrained from any movement off the couplers 30 longitudinal axis by the closeness of the fit between the outer diameter of the mandrel 14 and the internal diameter of the aperture 87 of the guide plate 36 and the mandrel 14 is therefore able to react to any unbalanced forces from the connectors 13 during their make up or operation.

Figure 5B:
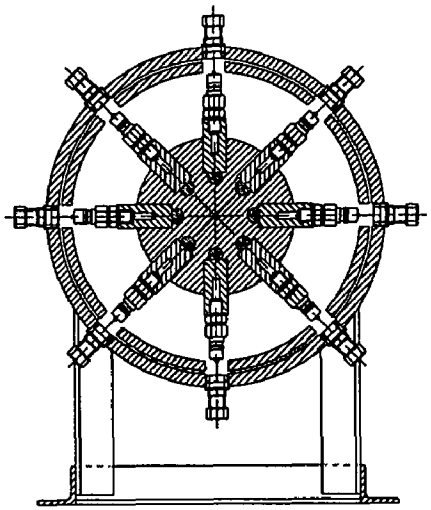
FIG. 5B is a view on section A of the apparatus of FIG. 5A.
Figure 5A:
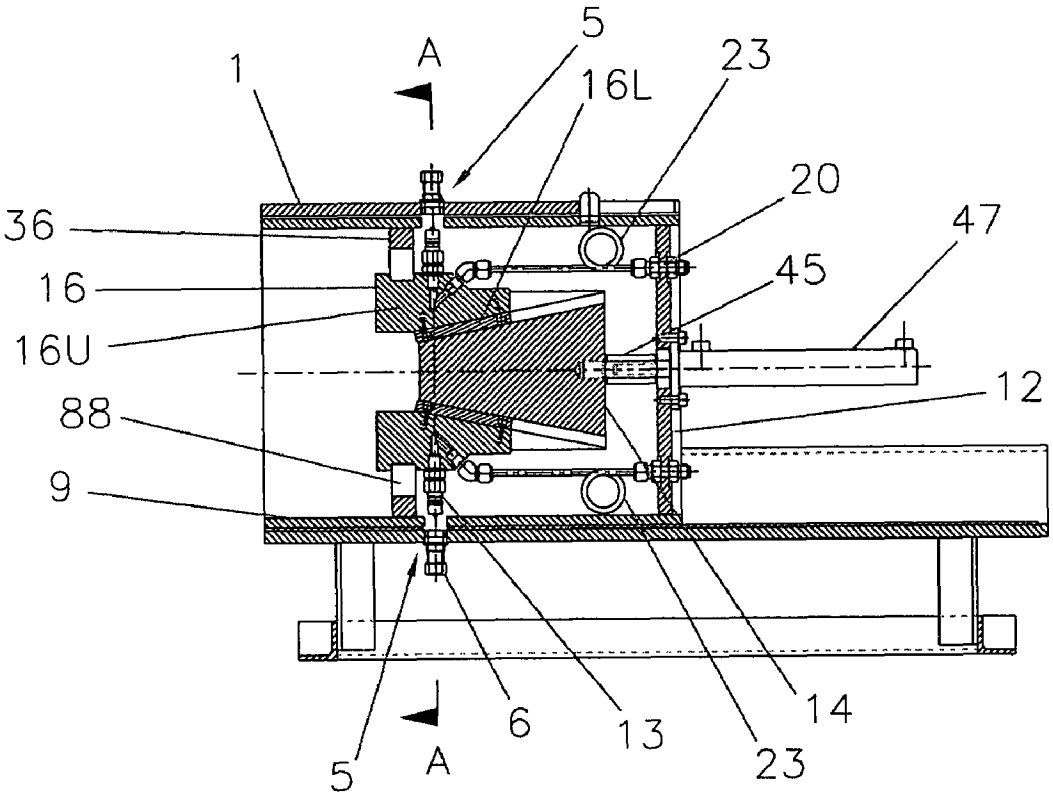
FIG. 5A is a cross-sectional view of the apparatus of FIG. 1 when assembled in an uncoupled configuration.
Figure 6B:
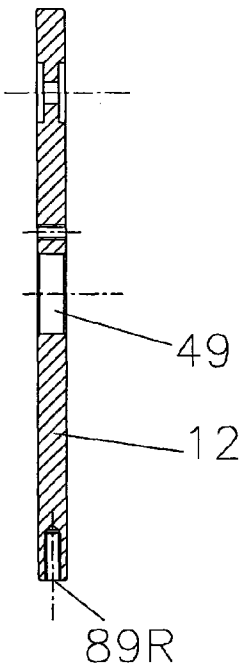
FIG. 6B is a view on section A of the end of back plate of FIG. 6A.
Figure 6A:
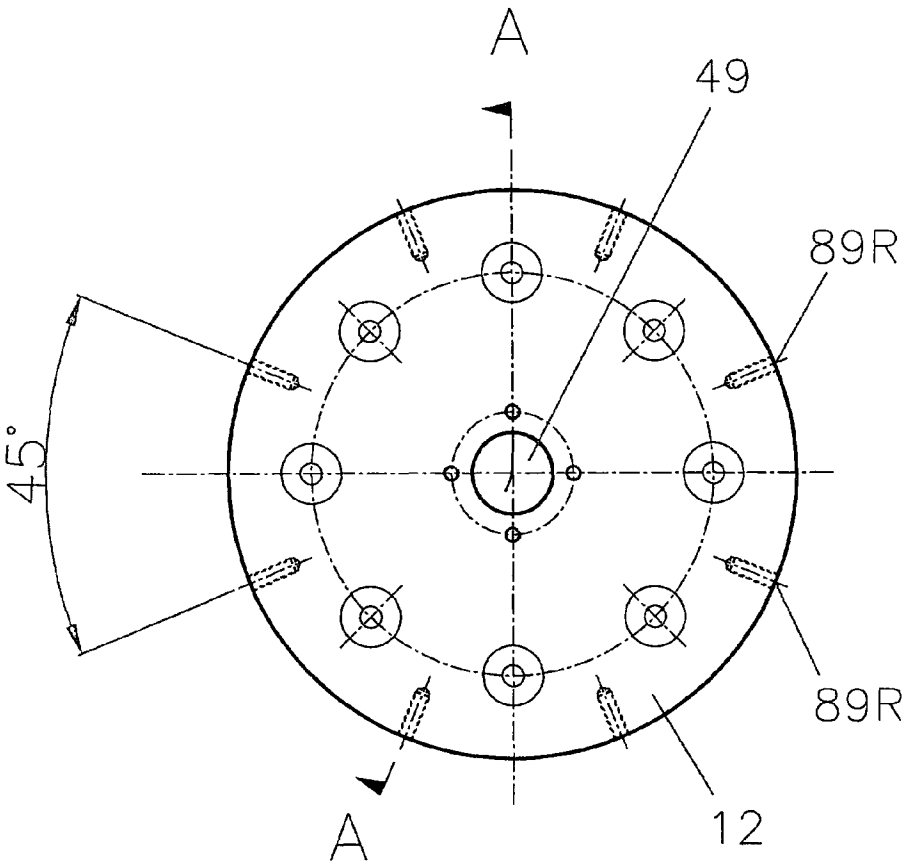
FIG. 6A is an end view of an end or back plate of the apparatus of FIG. 1.
Figures 7A, 7B:
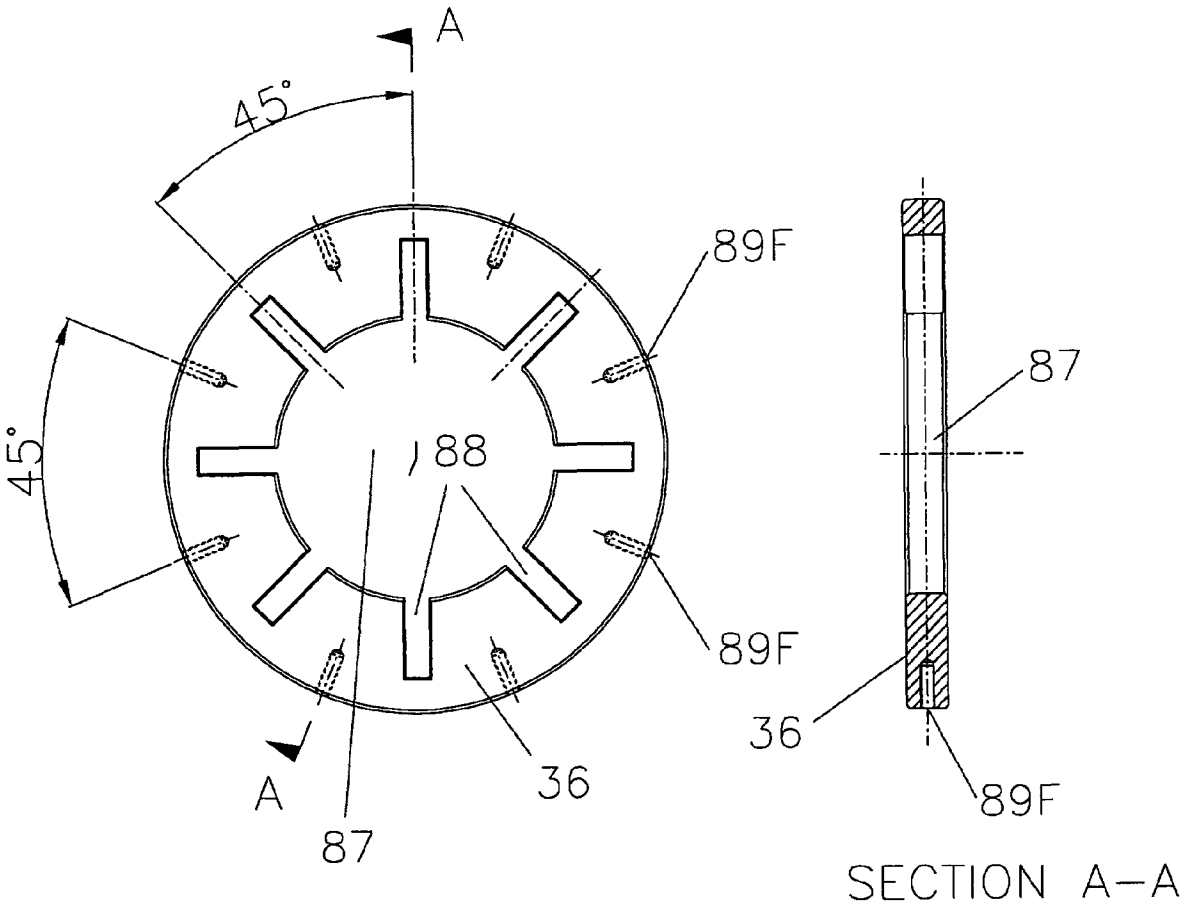
FIG. 7A is an end view of a guide plate of the apparatus of FIG. 1.
FIG. 7B is a view on section A of the guide plate of FIG. 7A.
Figures 8A, 8B:
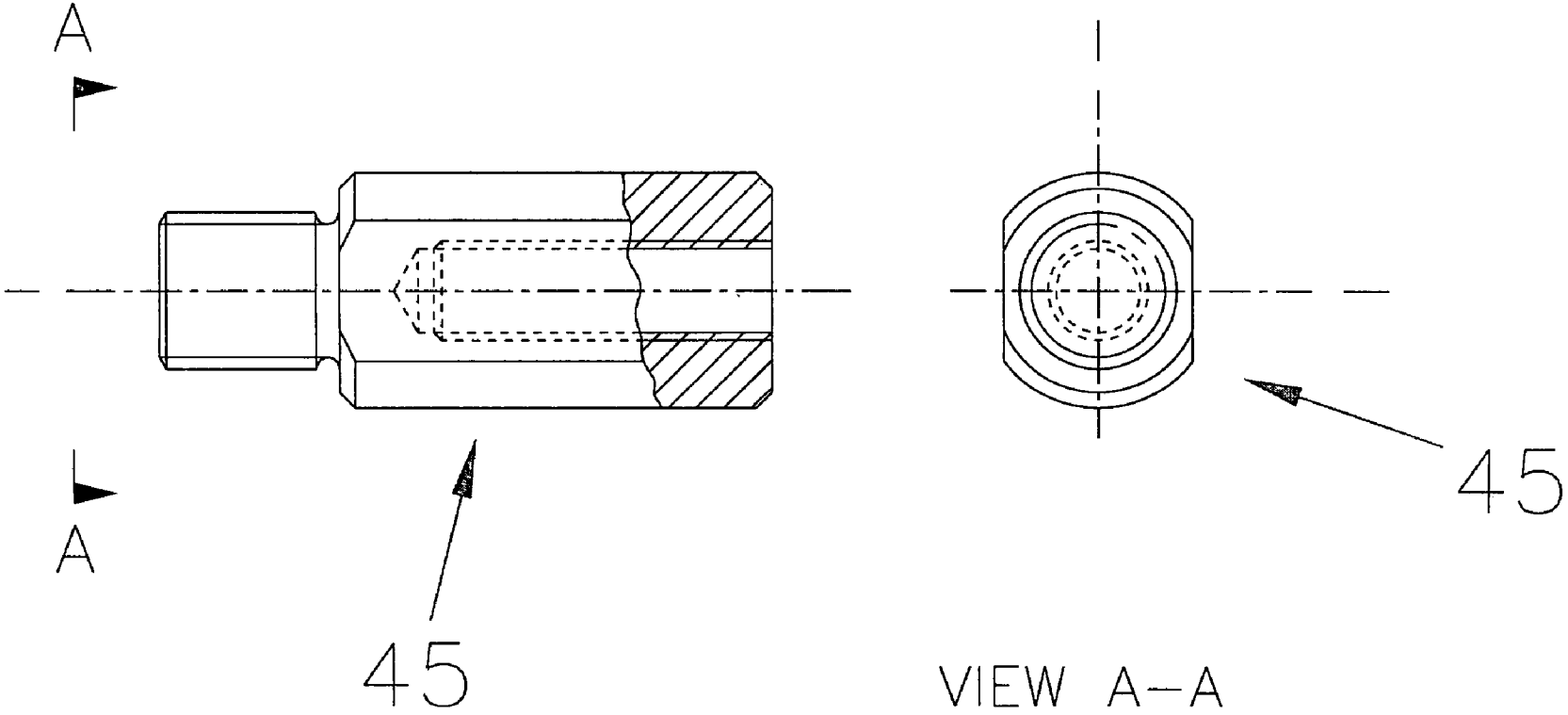
FIG. 8A is a side view of a cylinder spacer of the apparatus shown in FIG. 5A.
FIG. 8B is an end view of the cylinder spacer of FIG. 8A.
Figure 10A:
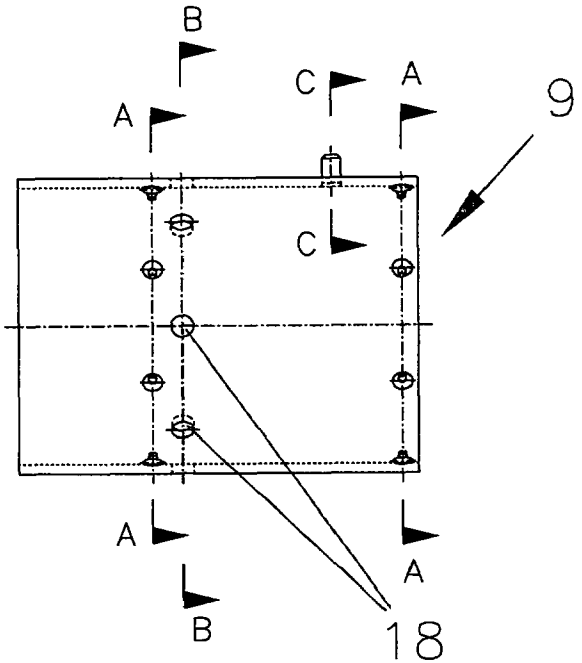
FIG. 10A is a side view of a body member of the apparatus of FIG. 1.
Figure 10B:
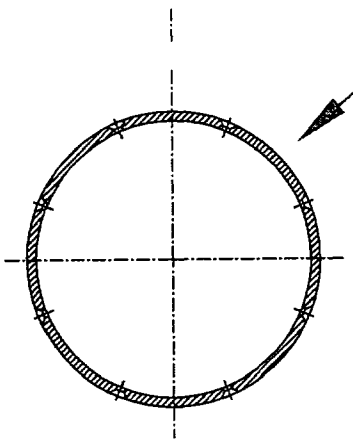
FIG. 10B is a view on section A of the body member of FIG. 10A.
Figure 10C:
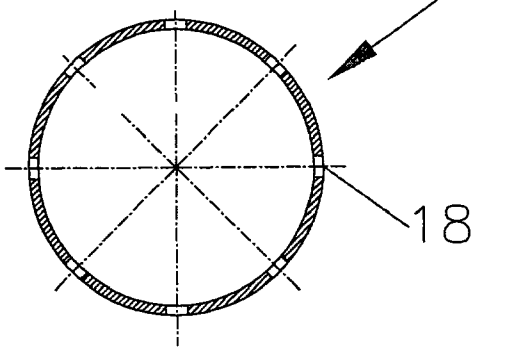
FIG. 10C is a view on section B of the body member of FIG. 10A.
Figure 10D:
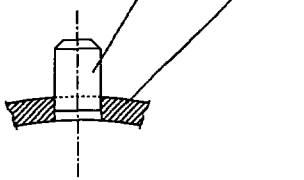
FIG. 10D is a detailed view on section C of the body member of FIG. 10A.
Figure 10E:
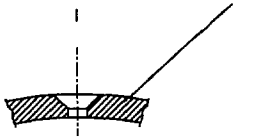
FIG. 10E is a detailed view of a countersunk hole best seen on the body member shown on FIG. 10B.
Figure 11C:
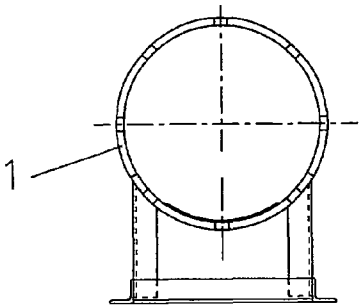
FIG. 11C is an end view of the housing of FIG. 11A.
Figure 11D:
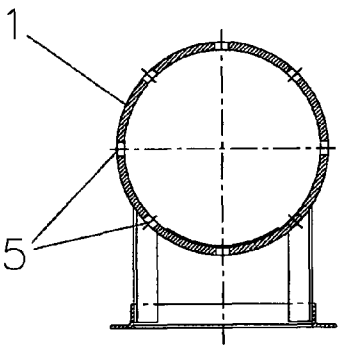
FIG. 11D is a view on section C of the housing of FIG. 11*a;*
Figure 11A:
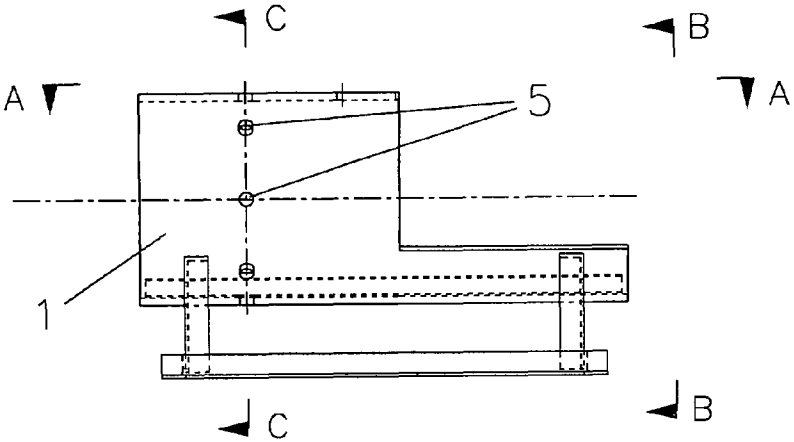
FIG. 11A is a side view of a housing of the apparatus of FIG. 5A.
Figure 11B:
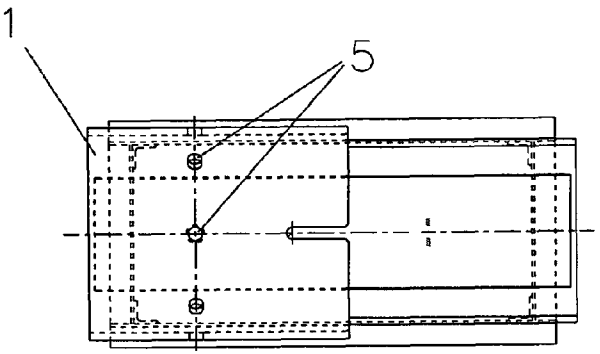
FIG. 11B is a plan view of the housing of FIG. 11A.
Figure 12B:
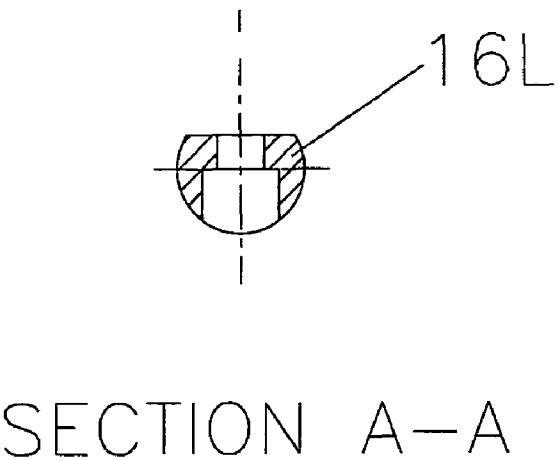
FIG. 12B is a view on section A of the sliding plate retaining bar of FIG. 12A.
Figure 12A:
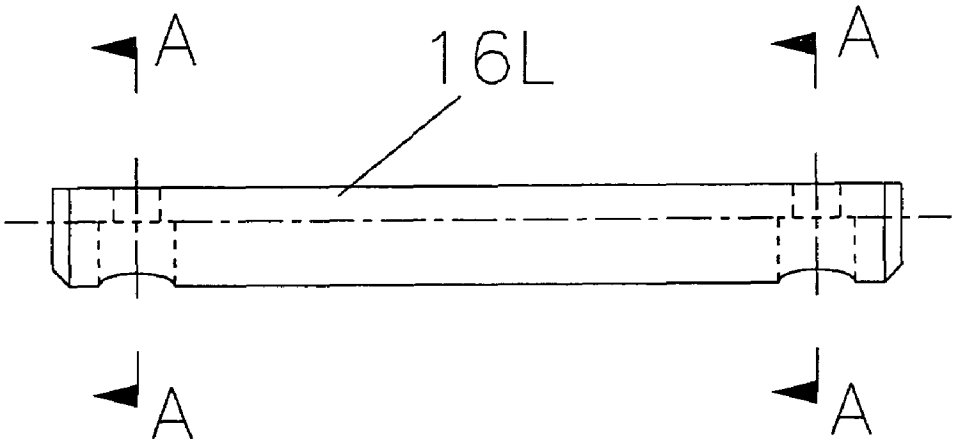
FIG. 12A is a side view of a sliding plate retainer bar shown in FIG. 5A.

The slots 88 in the guide plate 36 thereby permit the slider plates 16 to move radially outwardly, as shown in FIG. 5A, and prevent unwanted rotational movement of the slider plates 16. The radial slots 88 in the guide plate 36 are aligned rotationally with, but offset axially from, the apertures 18 in the casing 9.

The taper of each tapered channel 33 is designed to match the radial make up travel of the particular connectors 13 mounted in the particular slider plates 16, with the axial travel or stroke of the mandrel 14/cylinder 47.

The slider plates 16, cables 15, back plate 12, mandrel 14, guide plate 36 and cables are inserted as a unit into a first end 34 of the casing 9, until screw holes 89F provided around the outer circumference of the guide plate 36 are aligned with screw holes 90F formed through the side wall of the casing 9 and screw holes 89R provided around the outer circumference of the back plate 12 are aligned with screw holes 90R formed through the side wall of the casing 9. At that point, screws are inserted into the screw holes 90F, 90R and are tightened into screw holes 89F, 89R in order to fix the guide plate 36 and back plates 12 in position within the casing 9. The connector halves 13 of each cable are now radially aligned with the apertures 18 in the casing 9. An outwardly extending peg 8 is provided on the outer face of the casing 9 proximate to its rear end 34.

The nose cone 7 comprises a frusto-conical portion 39 and a cylindrical portion 40, wherein the rearmost end of the cylindrical portion 40 is attached to the front end 35 of the casing 9, and the frusto-conical portion 39 aids location of the male member 32 into the female receptacle 31, as will be described.

The female receptacle 31 comprises a tubular portion 1 and a frusto-conically shaped receptacle 2. Eight cable connectors 6 are equi-spaced around the outer face of the tubular portion 1.

The inner bore of the tube 1 has a diameter large enough to allow entry of the casing 9. The frusto-conical receptacle 2 is adapted to engage with the nose cone 7 to guide the male member 32 into the inner bore of the female receptacle 31. A slot 3 extends through the sidewall of a portion of the tubular portion 1 and a portion of the frusto conical receptacle 2 of the female receptacle 31, and is adapted to permit entry of the peg 8 of the casing 9, as described below, in order to rotationally and axially align the male member 32 and female receptacle 31.

The male 32 and female 31 members are now ready to be transported to their in use location, such as a subsea environment.

The individual cables/hoses (not shown) of the host facility/umbilical (not shown) not attached to the bulkhead connectors 20 are attached to the outermost ends of the connectors 6.

When the male 32 and female 31 members are to be connected, the following steps are taken.

In use, the male member 32 is inserted into the female receptacle 31. The nose cone 7 guides the male member 32 into the female receptacle 31. The peg 8 on the male member 32 engages with the slot 3 in the female receptacle 31 and so thereby resist rotational movement between the male member 32 and female receptacle 31.

The casing 9 continues into the tube 1 until the peg 8 on the casing 9 abuts against the front end of the slot 3 of the tube 1. Continued movement of the casing 9 into the tube 1 is thereby resisted.

At this point the connectors 13 in the apertures 18 of the casing 9 are axially and rotationally aligned with the connectors 6 in the apertures 5 of the housing 1.

The coupler 30 is now constructed and is in the configuration shown in FIGS. 5A and 5B with the connectors 13 rotationally aligned with the connectors 6 but spaced apart therefrom.

When it is desired that the connectors 13 be connected to the connectors 6, the cylinder 47 is actuated. This causes the piston within the cylinder 47 to move outwardly therefrom (right to left in FIG. 5A). This therefore causes the mandrel 14 to move away from the cylinder 47 and the mandrel 14 is pushed further into the female receptacle 31 since the mandrel 14 moves independently of the casing 9. The slider plates 16 lying within the tapered channels 33 on the mandrel 14 contact a wider (greater radius) portion of the tapered mandrel 14 and are pushed radially outwards. The cables 15 are also displaced radially outwards, with the coil 23 allowing movement of the cables 15. The slider plates 16 in turn push the connectors 13 further outwardly, through respective apertures 18 in the casing 9, such that the connectors 13 mate with the respective connectors 6 of the female receptacle 31.

The connection between the cables/hoses attached to the connectors 6 and the cables/hoses attached to the connectors 13 is thus formed. The mandrel 14 may be locked in position by continued application of e.g. hydraulic fluid pressure within the cylinder 47. Internal pressure or other environmental forces which may affect the connection are resisted by the slider plates 16 abutting with the tapered channels 14 thereby enhancing the integrity of the connection between the connectors 6 and 13.

To disengage the connection, the procedure is generally reversed, that is, the mandrel 14 is retracted by reverse operation of the cylinder 47. The slider plates 16 can then rest on a thinner (smaller diameter) portion of the tapered channels 14, and the keying action between the lower portion 33L and the slider plate retaining bar 16L forces the return of the slider plates 16. The connection is broken by the connectors 13 retracting back into the casing 9. If required, the male member 32 is then free to be retracted back out of the female receptacle 31.

Figure 13:
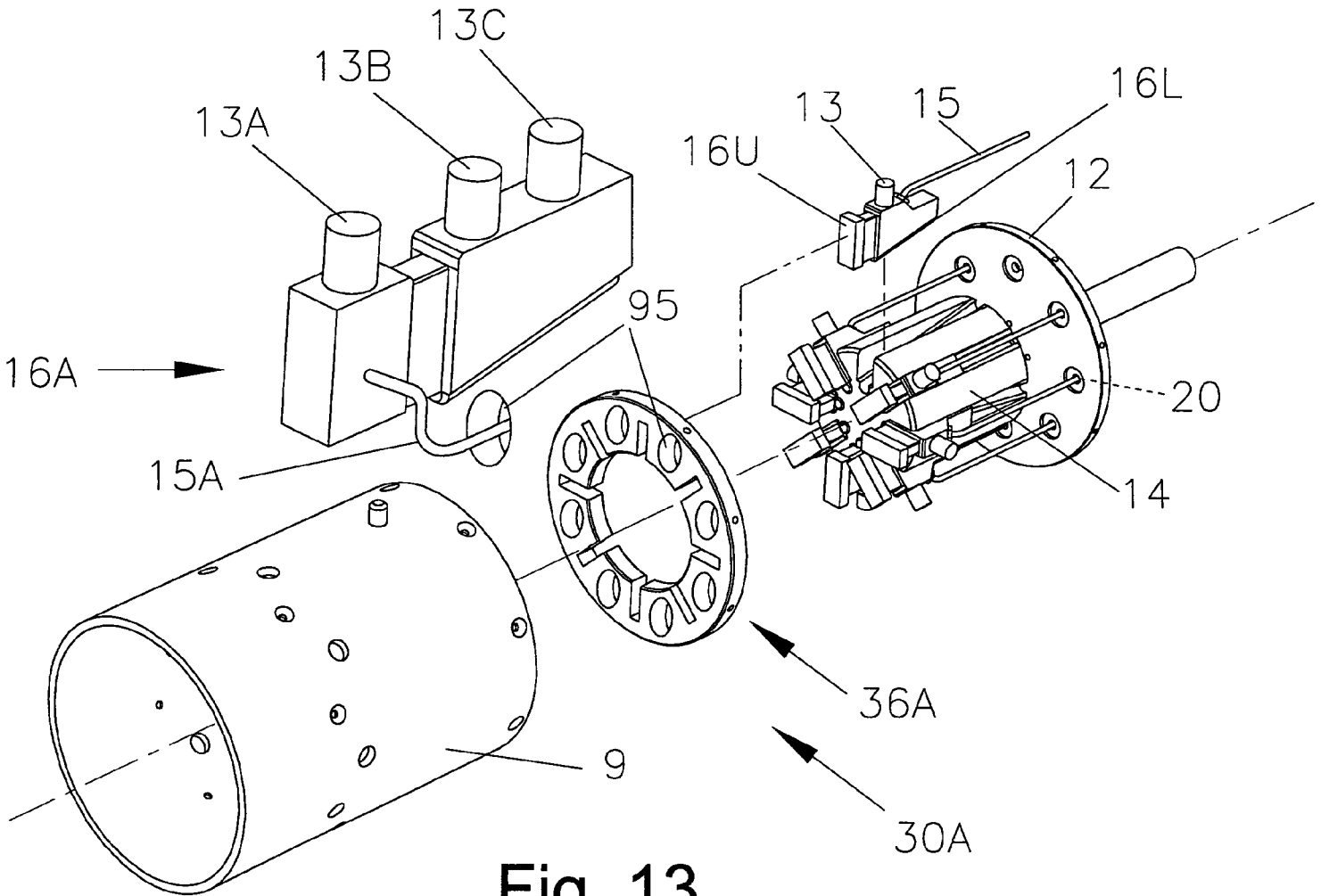
FIG. 13 is a perspective view of an alternative embodiment of a slider plate having three connections to that shown in FIG. 2.

An alternative embodiment of coupler 30A is shown in FIG. 13 where three connectors 13A, 13B, 13C are provided on the one slider plate 16A, for connection with three axially aligned but similarly spaced apart connectors (not shown) provided on the female member 31. The three connectors 13A, 13B, 13C will typically be provided with separate cables 15 containing the fluid or, for example, electrical signals. The cables 15 can connect into the rear most end of the slider plates 16 as in the first embodiment described above and can be routed through to the individual connectors 13A, 13B, 13C. Alternatively, the front most connector 13A can be provided with a separate pipe or cable 15A which projects out of the side of the slider plate 16 and which passes through an aperture 95 formed in the guide plate 36A.

The coupler 30 may be used to connect cables conveying any type of signals or power whatsoever including but not limited to pneumatic, electrical, hydraulic or optical signals or power.

It will be understood that although the embodiment described herein relates to a coupler connecting eight cables, the scope of the invention is not limited to such a coupler, as any number of cables may be connected with a coupler according to the present invention with simple modifications being made to the embodiment hereinbefore described. Furthermore, although the drawings show a generally cylindrically shaped coupler with a connector actuation mechanism aligned to it's central axis, the coupler could be another shape such as having a square or rectangular box cross sectional profile with the actuation mechanism (for example the mandrel 14, slider plates 16 and guide plate assembly 36) being either aligned to or offset from the central longitudinal axis.

Improvements and modifications may be made to the hereinbefore embodiments without departing from the scope of the invention. For example, the slider plate retaining bar 16L and lower portion 33L of the tapered channels need not necessarily be part circular, but could be any matching shape which provides a force to move the slider plates 16 both radially inwardly and radially outwardly. Also, the multiway coupler system 31, 32 is not size dependant and can be utilised for any size of connectors, varying from very small to very large. Furthermore, one or more pairs of connectors 6, 13 mounted on the slider plates 16 and the female coupler body 1 can be modified to form a mechanical locking connection (as well as or instead of a connective connection) in order to lock the male 32 and female 31 coupler bodies together. Indeed, such a pair of modified connectors, as well as providing a mechanical locking mechanism, would aid the final fine alignment of the male 32 and female 31 coupler bodies.

The invention claimed is:

1. An apparatus to connect a first cable to a second cable, the apparatus comprising:

a male member coupled to the first cable;

a female member coupled to the second cable, and an actuation mechanism comprising a tapered surface wherein at least a part of one of the first and second cables is connected to the tapered surface by a trapping means such that movement of the tapered surface along a longitudinal axis in a first direction forces, by virtue of the connection therebetween, the said at least part to move in a first direction substantially transverse to the longitudinal axis and movement of the tapered surface along the longitudinal axis in a second opposite direction forces, by virtue of the connection therebetween, the said at least part to move in a second opposite direction substantially transverse to the longitudinal axis, and wherein the trapping means are arranged to trap the at least part on the tapered surface to deny relative radial movement between the tapered surface and the said part.

2. An apparatus according to claim 1, wherein the trapping means comprises a key provided on one of the said part and the tapered surface and a slot in which the key is trapped provided on the other of the said part and the tapered surface.

3. An apparatus according to claim 1, wherein the male member comprises a mandrel wherein the tapered surface(s) are formed on the mandrel.

4. An apparatus according to claim 1, wherein the taper contact forces the said part to move in a first radial direction in response to movement of the tapered surface along the first direction of longitudinal movement of the male member in order to connect the first and second cables together and the trapping means forces the said part to move in the second radial direction in response to movement of the tapered surface along the second direction of longitudinal movement of the male member in order to disconnect the first and second cables.

5. An apparatus according to claim 1, wherein the trapping means are arranged to permit sliding movement between the said part and the tapered surface in either direction along the longitudinal axis of the male member.

6. An apparatus according to claim 1, wherein there are a plurality of tapered surfaces and the degree and/or the height of each tapered surface is arranged to provide the required length of radial movement required to connect the respective first cable to the respective second cable.

7. An apparatus according to claim 1, wherein the height of each of the parts of the first cables may be designed or matched with the desired or required length of radial movement required to connect the respective first cable to the respective second cable, such that a combination of different first cables having different sizes and make up travel lengths are accommodated.

8. An apparatus according to claim 1, further comprising a guide means to prevent rotational movement between the male and female members.

9. An apparatus according to claim 8, wherein the guide means further prevents non-radial movement of the said part of the first cable.

10. An apparatus according to claim 8, wherein the guide means prevents longitudinal movement of the said part that moves.

11. An apparatus according to claim 8, wherein the guide means further prevents rotational movement of the said part that moves.

12. An apparatus according to claim 8, wherein the guide means comprises a member having a longitudinal axis and one or more radially extending slots within which the said part is constrained.

13. An apparatus according to claim 12, wherein the said part comprises a flange portion which can act against an outer portion of the guide means surrounding the slot to prevent longitudinal movement of the said part.

14. An apparatus according to claim 13, wherein the male member comprises a mandrel, and wherein the mandrel is adapted to form a close fit within the guide means such that the guide means prevents nonlongitudinal movement of the mandrel and the mandrel is able to react to any unbalanced forces from the connectors during make up thereof.

15. An apparatus according to claim 8, wherein one or more cables may pass through apertures formed in the guide means.

16. An apparatus according to claim 1, wherein the said part of the first cable comprises a sliding surface adapted to permit longitudinal sliding movement with respect to the tapered surface and cause radial movement of the said part.

17. An apparatus according to claim 16, wherein more than one first cable may be provided with the same sliding surface such that the said more than one first cable move radially synchronously on the same sliding surface.

18. An apparatus according to claim 1, wherein at least part of the second cable is compliant, wherein the said at least part of the second cable is arranged to compensate for different tolerances in the length of travel of the said part of the first cable.

19. A method of connecting a first cable to a second cable, the method comprising the steps of:

providing a male member having a longitudinal axis coupled to the first cable;

providing a female member coupled to the second cable;

providing an actuation mechanism comprising a tapered surface wherein at least part of one of the first and second cables is connected to the tapered surface by a trapping means;

wherein the tapered surface is capable of moving along the longitudinal axis of the male member in a first direction such that the said part is forced by virtue of the connection therebetween to move in a first direction substantially transverse to the longitudinal axis in order to connect the first and second cables together;

wherein the tapered surface is capable of moving along the longitudinal axis in an opposite direction to force the said part to move in an opposite direction substantially transverse to the longitudinal axis in order to disconnect the first and second cables; and wherein the trapping means is capable of trapping the said part on the tapered surface to deny relative radial movement between the tapered surface and the said part.

20. An apparatus to connect a first cable to a second cable, the apparatus comprising:

a male member coupled to the first cable;

a female member coupled to the second cable, and an actuation mechanism operable to move at least a portion of the first cable relative to a portion of the second cable into connection together, wherein the said portion that moves is constrained in its movement by a guide means, wherein the actuation mechanism further comprises a tapered surface, wherein at least a part of one of the first and second cables is connected to the tapered surface by a trapping means arranged to trap the said at least part on the tapered surface to deny relative radial movement between the tapered surface and the said part.

21. An apparatus according to claim 20, wherein the guide means is arranged to prevent rotational movement between the male and female members.

22. An apparatus according to claim 20, wherein the guide means prevents non-radial movement of the said part that moves.

23. An apparatus according to claim 20, wherein the guide means prevents longitudinal movement of the said part that moves.

24. An apparatus according to claim 20, wherein the guide means prevents rotational movement of the said part that moves.

25. An apparatus according to claim 20, wherein the guide means comprises a substantially cylindrical member having one or more radially extending slots within which the said part is constrained such that the said part is aligned with the respective second cable prior to connection.

26. An apparatus according to claim 25, wherein the said part comprises a flange portion which is adapted to act against an outer portion of the guide means surrounding the slot to prevent longitudinal movement of the said part.

27. An apparatus according to claim 20, wherein one or more cables are permitted to pass through apertures formed in the guide means.

28. An apparatus according to claim 20, further comprising one or more mechanical locks provided on the male member and adapted to lock with respective one or more mechanical locks provided on the female member.

29. A method of connecting a first cable to a second cable, the method comprising the steps of:

providing a male member having a longitudinal axis coupled to the first cable;

providing a female member coupled to the second cable;

wherein actuation of an actuation mechanism moves at least a part of one of the first and second cables in a first direction substantially transverse to the longitudinal axis in order to connect the first and second cables together;

constraining the said part to move only along the first direction or in a second direction opposite to the first direction by a guide means; and wherein the said part is further connected to a tapered surface of the actuation mechanism by a trapping means arranged to trap the said at least part on the tapered surface to deny relative radial movement between the tapered surface and the said part.

* * * * *